US006619408B1

(12) United States Patent
Lai

(10) Patent No.: US 6,619,408 B1
(45) Date of Patent: Sep. 16, 2003

(54) HAMMER WITH SHOCK-RESISTANT ARRANGEMENT

(75) Inventor: Chao Hong Lai, Taichung (TW)

(73) Assignee: Chang Rong Chen, Taichung Hsien (TW)

( * ) Notice: Subject to any disclaimer, the term of this patent is extended or adjusted under 35 U.S.C. 154(b) by 0 days.

(21) Appl. No.: 10/230,740

(22) Filed: Aug. 29, 2002

(30) Foreign Application Priority Data

Aug. 9, 2002 (TW) ..... 091212472 A

(51) Int. Cl.[7] ..... B25D 1/00

(52) U.S. Cl. ..... 173/90; 173/170; 173/162.2; 81/20; 81/22; 16/110.1

(58) Field of Search ..... 173/90, 170, 171, 173/162.2; 81/20, 22, 27, 26; 16/110.1

(56) References Cited

U.S. PATENT DOCUMENTS 4,683,784 A * 8/1987 Lamont ..... 81/22
5,099,724 A * 3/1992 Reddy, Jr. ..... 81/20
5,299,475 A * 4/1994 Stroop ..... 81/20
6,202,511 B1 * 3/2001 Murray et al. ..... 81/22
6,386,070 B1 * 5/2002 Hong ..... 16/110.1
6,405,616 B1 * 6/2002 Chen ..... 81/20

* cited by examiner

*Primary Examiner*—Scott A. Smith
(74) *Attorney, Agent, or Firm*—Pro-Techtor International Services

(57) ABSTRACT

A hammer comprises a metal bar extended from a head, the bar including forward and rearward apertures; a soft sleeve including spaced lengthwise internal ribs, the ribs being fastened across the bar, forward and rearward staged holes disposed corresponding to the apertures respectively; two forward fastening elements each including a catch inserted into one aperture for preventing the bar from disengaging from the sleeve; a rearward fastening assembly including a left fastener including a bore in a shank and spaced recessed rings around the bore and a right fastener including spaced collars on a shank thereof, the collars being disposed matingly with respect to the recessed rings so that the bar and the sleeve are fastened together by snapping the collars into the rings through the rearward staged hole and the rearward aperture; and a hard handle formed on the sleeve. The ribs and the sleeve can absorb shock.

6 Claims, 4 Drawing Sheets

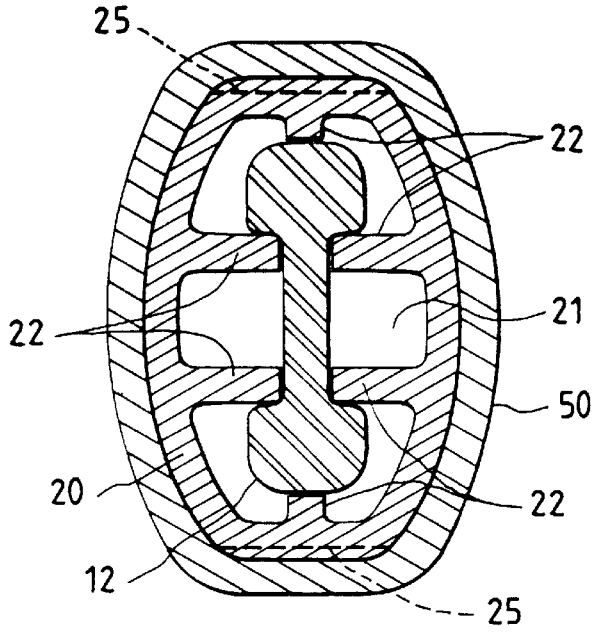
FIG, 2
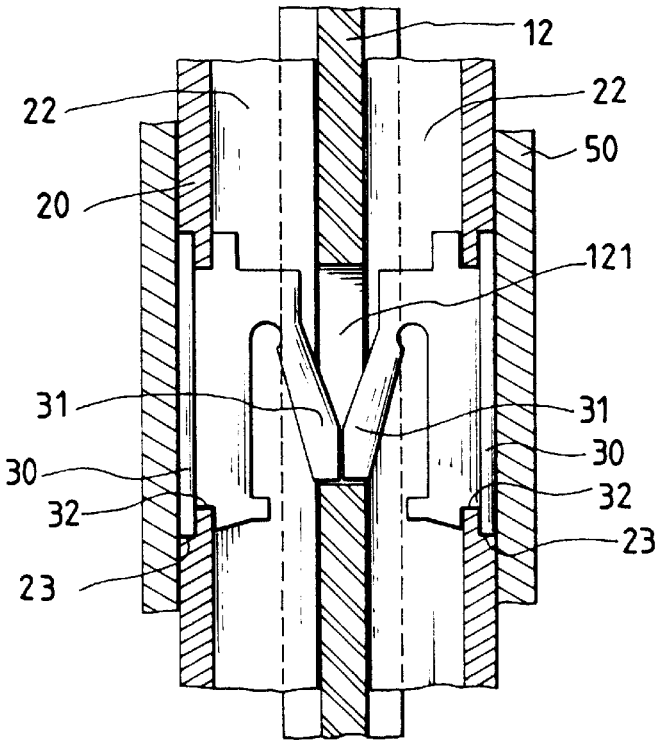
FIG, 3

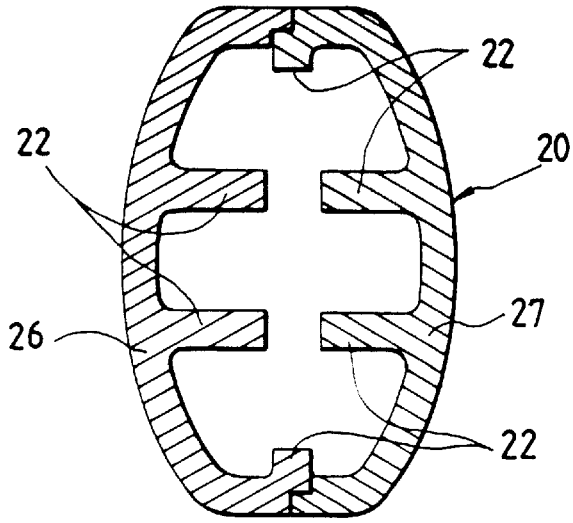
FIG, 7
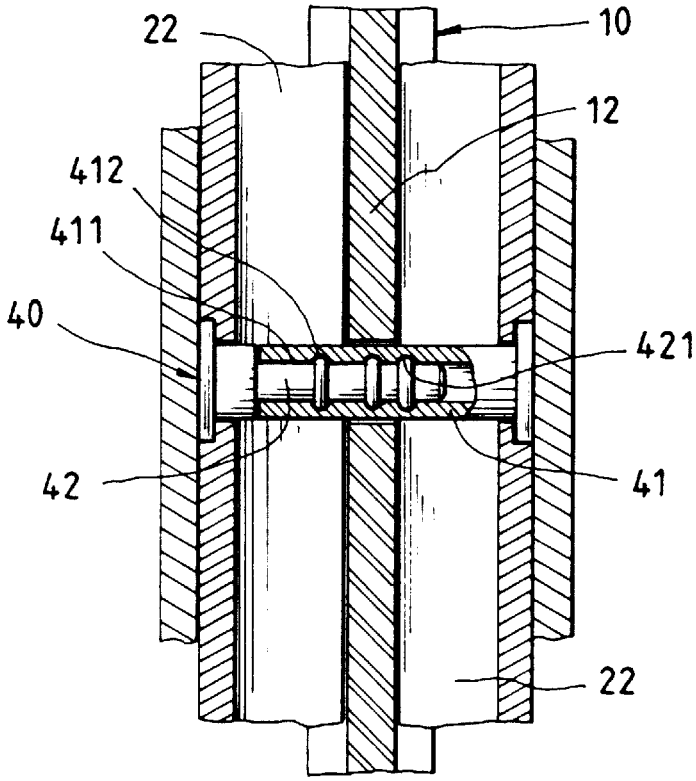
FIG, 4

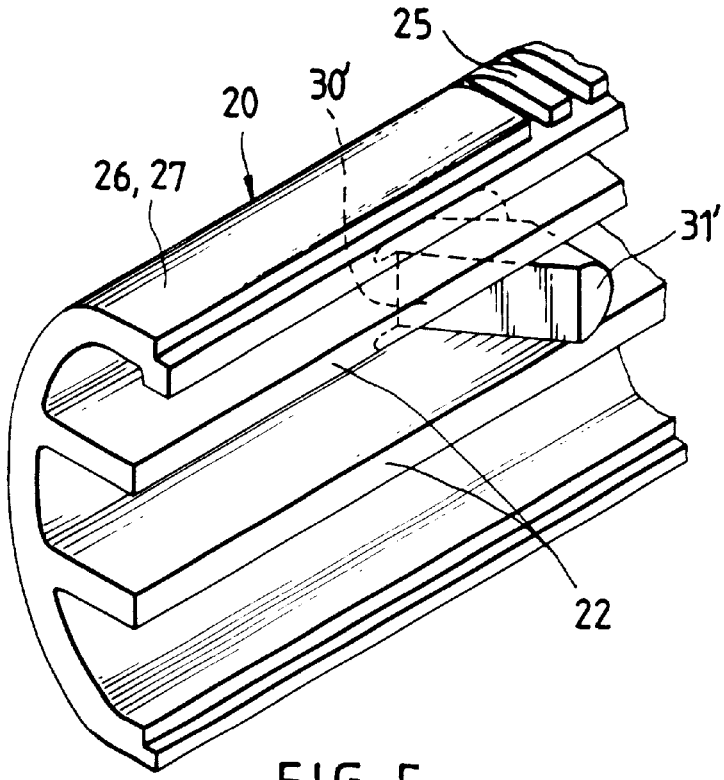
FIG, 5
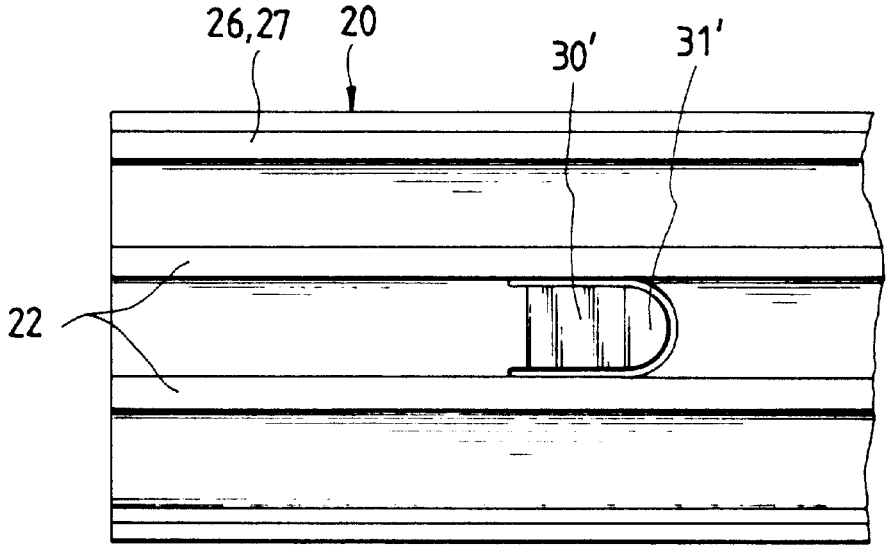
FIG, 6

HAMMER WITH SHOCK-RESISTANT ARRANGEMENT

FIELD OF THE INVENTION

The present invention relates to hammers and more particularly to a hammer with a shock-resistant arrangement for significantly reducing shock while pounding an object.

BACKGROUND OF THE INVENTION

A conventional hammer has a metal head fastened across one end of a wood handle. In use, a user may lift the hammer to pound an object (e.g., a nail). However, a strong shock caused by the pounding may also transmit to the hand. This may cause a degree of discomfort to the user. To the worse, even the head of the user may be hurt by the strong shock. Hence, a need exists for the provision of a shock-resistant hammer.

SUMMARY OF THE INVENTION

It is therefore an object of the present invention to provide a hammer comprising a metal body including a head and an elongate bar extended backward, the bar including a forward elliptical aperture and a rearward circular aperture; an elongate soft sleeve formed of plastic, the sleeve including a plurality of spaced lengthwise ribs integrally formed around an inner surface, the ribs being fastened across the bar, a forward staged hole, and a rearward staged hole both disposed corresponding to the elliptical and the circular apertures respectively; a pair of forward fastening elements each including a catch inserted into the elliptical aperture for preventing the bar from disengaging from the sleeve; a rearward fastening assembly including a left fastener including a head, a shank, a bore in the shank, and a plurality of spaced apart recessed rings around the bore and a right fastener including a head, a shank, and a plurality of spaced apart collars on the shank thereof, the collars being disposed matingly with respect to the recessed rings so that the bar and the sleeve are fastened together by snapping the collars of the right fastener into the recessed rings of the left fastener through the rearward staged hole of the sleeve and the circular aperture of the bar; and a hard handle formed on the sleeve; whereby a shock caused by pounding an object by the hammer is substantially absorbed by the ribs and the sleeve.

In one aspect of the present invention, the sleeve is formed of two detachable identical members for reducing a manufacturing cost.

The above and other objects, features and advantages of the present invention will become apparent from the following detailed description taken with the accompanying drawings.

BRIEF DESCRIPTION OF THE DRAWINGS

FIG. 2 is a cross-sectional view of handle of the hammer;

FIG. 3 is a cross-sectional view showing details of forward fastening elements for securing bar of the hammer to sleeve thereof;

FIG. 4 is a cross-sectional view showing details of rearward fastening assembly for securing bar of the hammer to sleeve thereof;

FIG. 5 is a broken apart interior view showing ribs of sleeve of a hammer according to a second preferred embodiment of the invention;

FIG. 6 is a side view of FIG. 5; and

FIG. 7 is a cross-sectional view of sleeve of the hammer according to the second preferred embodiment of the invention.

DETAILED DESCRIPTION OF THE PREFERRED EMBODIMENTS

Figure 1:
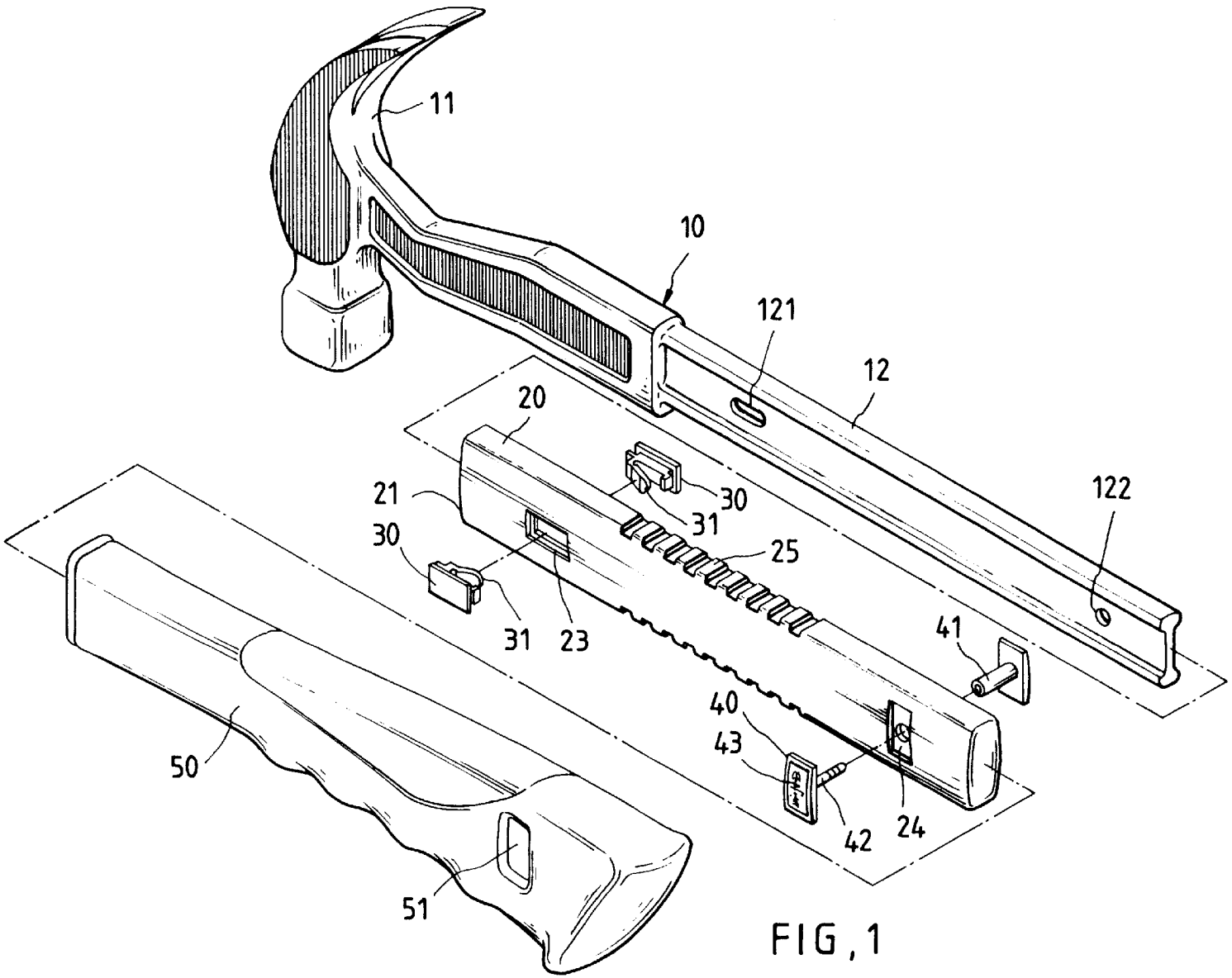
FIG. 1 is an exploded view of a first preferred embodiment of a hammer with shock-resistant arrangement according to the invention.

Referring to FIGS. 1 to 4, there is shown a first preferred embodiment of a hammer constructed in accordance with the invention comprising a metal body 10 including a head 11 and a bar 12 extended backward. The bar 12 may have any section. In this embodiment, the bar 12 has a section of 1. The bar 12 comprises a forward elliptical aperture 121 and a rearward circular aperture 122.

The hammer further comprises a soft sleeve 20 formed of plastic material such as polypropylene (PP). The sleeve 20 is elongate having two substantially curved sides and flat top and bottom sides. The sleeve 20 comprises a plurality of spaced lengthwise ribs 22 integrally formed around an inner surface (i.e., in a channel 21). The ribs 12 are fastened across the bar 12. The sleeve 20 further comprises a forward staged hole 23 and a rearward staged hole 24 disposed corresponding to the elliptical aperture 121 and the circular aperture 122 respectively; and a knurl 25 on each of the top and bottom sides.

Each of a pair of forward fastening elements 30 comprises a catch 31 inserted into the elliptical aperture 121. for preventing the bar 12 from disengaging from the sleeve 20 after installed. A rearward fastening assembly 40 comprises a left fastener 41 and a mating right fastener 42. The left fastener 41 is shaped like a pin and comprises a bore 411 in its shank and a plurality of spaced apart recessed rings 412 around the bore 411. Also, the right fastener 42 comprises a plurality of spaced apart collars 421 on its shank. The collars 421 are disposed matingly with respect to the recessed rings 412. Hence, the bar 12 and the sleeve 20 are fastened together by snapping the collars 421 of the right fastener 42 into the recessed rings 412 of the left fastener 41 through the rearward staged hole 24 of the sleeve 20 and the circular aperture 122 of the bar 12.

The hammer further comprises a hard handle 50 formed on the sleeve 20 by injection molding. Note that provision of the knurls 25 can increase a fastening of the sleeve 20 and the handle 50. The handle 50 comprises a rectangular opening 51 in the rear. An outer surface 43 of the head of either left fastener 41 or right fastener 42 is substantially flush with the edge of the opening 51. Hence, a mark stamped on the outer surface 43 of the head of the left fastener 41 or right fastener 42 may be shown on the opening 51 for identification.

It is envisaged that shock caused by pounding an object by the hammer can be substantially absorbed by the ribs 22 and the sleeve 20. Thus, only a minimum shock is felt by the user.

Referring to FIGS. 5 to 7, there is shown a second preferred embodiment of a hammer constructed in accordance with the invention. The characteristics of the second preferred embodiment are detailed below. The soft sleeve 20 consists of a left member 26 and a mated right member 27 so as to be matingly assembled together. As shown in FIG. 7, only one mold is needed to manufacture both members 26 and 27, resulting in a reduction in the manufacturing cost. Further, the forward fastening elements 30 having catches 31 are integrally formed with members 26 and 27.

While the invention has been described by means of specific embodiments, numerous modifications and variations could be made thereto by those skilled in the art without departing from the scope and spirit of the invention set forth in the claims.

What is claimed is:

1. A hammer comprising:

a metal body including a head and an elongate bar extended backward, the bar including a forward elliptical aperture and a rearward circular aperture;

an elongate soft sleeve formed of plastic, the sleeve including a plurality of spaced lengthwise ribs integrally formed around an inner surface, the ribs being fastened across the bar, a forward staged hole, and a rearward staged hole both disposed corresponding to the elliptical and the circular apertures respectively;

a pair of forward fastening elements each including a catch inserted into the elliptical aperture for preventing the bar from disengaging from the sleeve;

a rearward fastening assembly including a left fastener including a head, a shank, a bore in the shank, and a plurality of spaced apart recessed rings around the bore and a right fastener including a head, a shank, and a plurality of spaced apart collars on the shank thereof, the collars being disposed matingly with respect to the recessed rings so that the bar and the sleeve are fastened together by snapping the collars of the right fastener into the recessed rings of the left fastener through the rearward staged hole of the sleeve and the circular aperture of the bar; and a hard handle formed on the sleeve;

whereby a shock caused by pounding an object by the hammer is substantially absorbed by the ribs and the sleeve.

2. The hammer of claim 1, wherein the sleeve is integrally formed.

3. The hammer of claim 1, wherein the sleeve is formed of two detachable identical members.

4. The hammer of claim 1, wherein the handle comprises a rear opening for exposing the head of either fastener.

5. The hammer of claim 1, wherein the sleeve further comprises at least one knurl on its outer surface for increasing a fastening of the sleeve and the handle.

6. The hammer of claim 1, wherein the pair of forward fastening elements are integrally formed with the sleeve.

* * * * *